US007188499B2

(12) United States Patent
Ogaki et al.

(10) Patent No.: US 7,188,499 B2
(45) Date of Patent: Mar. 13, 2007

(54) METHOD AND DEVICE FOR PROCESSING OUTER SHAPE OF CAN SHELL

(75) Inventors: Takuhiro Ogaki, Iwatsuki (JP); Munehisa Hattori, Iwatsuki (JP); Shusaku Takahashi, Iwatsuki (JP); Masayuki Takei, Iwatsuki (JP); Hideyuki Tamura, Iwatsuki (JP); Yuri Takeda, Iwatsuki (JP)

(73) Assignee: Hokkai Can Co., Ltd., Tokyo (JP)

( * ) Notice: Subject to any disclaimer, the term of this patent is extended or adjusted under 35 U.S.C. 154(b) by 33 days.

(21) Appl. No.: 10/513,852

(22) PCT Filed: May 9, 2003

(86) PCT No.: PCT/JP03/05834

§ 371 (c)(1),
(2), (4) Date: Nov. 9, 2004

(87) PCT Pub. No.: WO03/095126

PCT Pub. Date: Nov. 20, 2003

(65) Prior Publication Data

US 2005/0183256 A1 Aug. 25, 2005

(30) Foreign Application Priority Data

May 10, 2002 (JP) ..... 2002-135673
Oct. 15, 2002 (JP) ..... 2002-300768

(51) Int. Cl.
*B21B 27/00* (2006.01)
*B21D 15/00* (2006.01)

(52) U.S. Cl. ..... 72/102; 72/57; 72/121; 72/715

(58) Field of Classification Search ..... 72/91, 72/92, 94, 102, 107, 109, 121, 54, 56, 57, 72/465.1, 466.7, 715
See application file for complete search history.

(56) References Cited

U.S. PATENT DOCUMENTS 3,812,696 A * 5/1974 Kneusel et al. ..... 72/57
4,903,515 A * 2/1990 Park ..... 72/85
4,953,376 A * 9/1990 Merlone ..... 72/57
5,761,942 A * 6/1998 Johnson et al. ..... 72/94
6,167,743 B1 * 1/2001 Marritt et al. ..... 72/352

(Continued)

FOREIGN PATENT DOCUMENTS

JP 49-102566 9/1974

(Continued)

*Primary Examiner*—Ed Tolan
(74) *Attorney, Agent, or Firm*—Birch, Stewart, Kolasch & Birch, LLP

(57) ABSTRACT

A pressing member 44 is pressed from the outside against a peripheral wall of a can shell 4 whose interior is maintained at a predetermined pressure by gas, to form a recess-deformed portion 56 having a predetermined shape on the peripheral wall of the can shell 4. Thereby, three-dimensional patterns can be formed by recess-deforming desired portions of the can shell 4 while preventing the strength of the can shell 4 from being deteriorated and preventing the inner surface of the can shell 4 from being scratched or the coating from being damaged, by which outer shape processing with high design performance can be easily applied to the can shell 4 at a low cost.

22 Claims, 12 Drawing Sheets

U.S. PATENT DOCUMENTS 6,343,496 B1 * 2/2002 Hanna et al. ..... 72/61

FOREIGN PATENT DOCUMENTS

| | | | |
|---|---|---|---|
| JP | 49-109180 | | 10/1974 |
| JP | 50-2664 | | 1/1975 |
| JP | 50-108157 | | 8/1975 |
| JP | 61-193728 | A | 8/1986 |
| JP | 6-15389 | A | 1/1994 |
| JP | 7-300124 | A | 11/1995 |
| JP | 9-136127 | A | 5/1997 |
| JP | 10-94848 | A | 4/1998 |
| JP | 2000-84636 | A | 3/2000 |

* cited by examiner

METHOD AND DEVICE FOR PROCESSING OUTER SHAPE OF CAN SHELL

This application is a 35 USC 371 of PCT/JP03/05834 field May 9, 2003.

TECHNICAL FIELD

The present invention relates to a method and device for processing the outer shape of a can shell and improving the design performance thereof by recess-deforming a desired portion of the can shell and creating a three-dimensional pattern.

BACKGROUND ART

Heretofore, an art of processing the outer shape of a can shell for storing beverages, foods etc. to improve the design performance of the can shell by recess-deforming the can shell and forming a three-dimensional pattern thereto is known.

Upon performing this type of outer shape processing, for example, a pair of receive molds is inserted to the interior of a cylindrical can shell from openings formed on both sides of the can shell, by which a molding portion corresponding to the shape of the recess deformation is formed by the confronting width between the ends facing each other of the pair of receive molds. On the other hand, a pressure roller is applied to press the area corresponding to the mold portion from the outer side of the can shell. Then, the can shell is rotated while maintaining the pressing operation by the pressure roller, by which the whole circumference of the can shell is recess-deformed.

However, when the recess-deformation is formed using the pressure roller and the receive mold, the wall thickness of the recessed portion is reduced due to the draw deformation by the pressure roller and the receive mold, by which the strength of the can shell is disadvantageously deteriorated.

Further, when performing this type of outer shape processing by inserting a receive mold into the can shell, the receive mold contacts and slides against the inner surface of the can shell and may generate scratches on the inner surface of the can shell, and especially if the inner surface of the can shell is coated with a coating or the like, may damage the coating. Furthermore, by using a receive mold, the shape of the receive mold may remain on the can shell, which may deteriorate the appearance of the three-dimensional pattern.

Moreover, if a can lid is crimped onto one end of the can shell, or if a bottom portion is integrally formed to the cylindrical portion as in a so-called two-piece can shell, the receive mold can only be inserted from the opening portion at one end of the can shell, which may cause a drawback in that a desired recess shape cannot be obtained.

Furthermore, since it is necessary to have the positions of the pressure roller and the receive mold correspond accurately, the device configuration became complex, which disadvantageously increased the price of the device and increased the manufacture costs.

Therefore, another prior art method is known in which a can shell is placed inside an outer die having a three-dimensional pattern formed on its inner side, a molding head equipped with a rubber expansion unit that is expandable toward the outer circumferential direction is inserted to the interior of the can shell, and the expansion unit is expanded by water pressure to press the can shell against the inner surface of the outer die and to process the three-dimensional pattern on the inner surface of the outer die to the outer surface of the can shell. According to this method, since the rubber expansion unit comes into contact with the inner surface of the can shell, the inner surface of the can shell can be prevented from being damaged.

According to this method, however, since the expansion unit is expanded to expand the can shell and to form a pattern on the can shell, there is a drawback in that outer shape processing aimed at shrinking the diameter of the can shell cannot be performed. Further, the molding head must have a complex structure since it must have in addition to the expansion unit a flow path for supplying water to the expansion unit and so on, and even further, the can shell must be expanded by applying extremely high pressure to the expansion unit so as to press the can shell against the inner surface of the outer die, so the cost of the device becomes expensive, and the manufacture cost is disadvantageously increased. Furthermore, since the can shell is deformed by the pressure by the rubber expansion unit applied from the inner side of the can shell, even if it is desirable to form plural relatively close recess portions on the outer surface of the can shell, for example, there is a drawback in that the recessed portions cannot be formed sufficiently on the outer surface of the can shell.

In order to solve the drawbacks mentioned above, the present invention aims at providing a method and device for processing the outer shape of a can shell that prevents the strength of the can shell from deteriorating and also reliably prevents the inner surface of the can shell from being scratched or the coating from being damaged, that enables outer shape processing to be performed to even can shells having one end closed, and that enables outer shape processing with improved design performance to be easily performed at low costs and without complicating the device configuration.

SUMMARY OF THE INVENTION

The present invention provides a method for processing an outer shape of a can shell by recess-deforming a desired portion of a cylindrical can shell and forming a three-dimensional pattern thereto, characterized in comprising a press molding step of pressing a pressing member from an exterior against a peripheral wall of the can shell having its interior maintained at predetermined pressure by gas and forming a recess-deformed portion having a predetermined shape on the peripheral wall of the can shell.

The present inventors have conducted various tests, and discovered that by pressing a pressing member against the outer surface of the peripheral wall of a can shell having its interior maintained at predetermined pressure by gas, it is possible to form a recess having the desired shape accurately to the peripheral wall of the can shell without having to insert a receive mold to the interior of the can shell as in the prior art.

That is, since during the above pressure molding step, the gas within the can shell is maintained at predetermined pressure, so the pressure is applied uniformly to the inner surface of the peripheral wall of the can shell toward the outer direction of the can shell. When pressing the outer surface of the peripheral wall of the can shell by a pressing member in this state, the peripheral wall of the can shell at the portion of contact of the pressing member is recessed, but at the same time, at the areas that are not in contact with the pressing member, the gas having predetermined pressure exerts an action similar to that of the prior art receive mold and suppresses deformation of the can shell. Thus, it is possible to subject only the contact portion of the pressing member to recess deformation without having to insert a receive mold or a molding head to the interior of the can shell as in the prior art, so the present invention enables to provide outer shape processing to a can shell at low cost.

Since draw deformation caused by receive molds as according to the prior art are not generated in the direction of wall thickness of the can shell, almost no reduction in wall thickness occurs at the recess-deformed portion, and outer shape processing can be performed without deteriorating the strength of the can shell. Moreover, since the receive mold as according to the prior art is not necessary, the inner surface of the can shell can be infallibly prevented from being scratched and so on.

Further, according to the method of the present invention, it is desirable to perform, prior to the press molding step, a can shell retaining step of gripping the can shell with a pair of retention members that contact both ends of the can shell in the axial direction so as to retain the can shell with an outer surface of the peripheral wall of the can shell exposed and the interior of the can shell sealed, and a gas introducing step of introducing gas into the interior of the can shell through a gas inlet provided to at least one of the retention members while maintaining the retained state of the can shell by the can shell retaining step and maintaining the interior of the can shell at a predetermined pressure by gas.

According to this method, at first, the can shell retaining step is performed to retain the can shell with the outer surface of the peripheral wall of the can shell exposed. At this time, the can shell is retained by a pair of retention members so that the interior thereof is sealed. Next, the gas introducing step is performed to introduce gas into the interior of the can shell through a gas inlet provided to the retention member. Both ends of the can shell are sealed and retained by two retention members, and so the interior of the can shell is raised to predetermined pressure. Thereafter, the press molding step is performed. According to this method, the press molding step can be performed efficiently to the can shell having its interior maintained at predetermined pressure by gas. According further to the method for processing the outer shape of the present invention, since gas is introduced to the interior of the can shell through a gas inlet provided to at least one of the retention members, outer shape processing can be provided easily not only to can shells having both ends opened but also for example to a can shell so-called a three-piece can in which one end is opened and the other end has a can lid crimped thereon, or to a two-piece can shell in which the bottom portion and the can shell are formed integrally. Further, outer shape processing can be performed without any problem to a can shell provided with a neck-in process or a flange process.

Moreover, according to the press molding step of the present invention, a circumference portion of the pressing member taking the form of a rotatably disposed roller is pressed against the outer wall of the can shell and rolled so as to form a recess-deformed portion that is continuous throughout a predetermined range in the peripheral wall of the can shell. Accordingly, it becomes possible to provide a recess-deformation throughout the whole circumference of the peripheral wall of the can shell, and outer shape processing of the can shell can be performed extremely efficiently.

According to one aspect of the press molding step, the pressing member is pressed against and rolled on the peripheral wall of the can shell and moved for a predetermined distance in the axial direction of the can shell so as to form a recess-deformed portion that is recessed continuously throughout a predetermined range in the axial direction of the can shell, so as to form a recess having a desired width. According to this method, even by using a pressing member having a single pressing width, the width of the recess-deformed portion can be adjusted easily by varying the distance of movement of the pressing member.

At this time, a pressurizing force of the pressing member pressing the can shell is gradually increased or decreased during movement of the pressing member in the axial direction of the can shell so as to deform the can shell into a tapered shape, so it becomes possible to form a can shell with an advantageous design performance easily.

Moreover, according to the present method, the pressing member is disk-shaped and disposed rotatably, having formed on its circumference portion a plurality of projections having predetermined shapes that are arranged at predetermined intervals along the circumferential direction of the pressing member, wherein during the press molding step, the circumference portion of the pressing member is pressed against and rotated on the outer wall of the can shell so as to extremely efficiently form a plurality of recess-deformed portions arranged at predetermined intervals on the peripheral wall of the can shell by recessing the peripheral wall of the can shell with the projections.

At this time, by press-rolling the pressing member in the circumferential direction of the can shell at predetermined intervals in the axial direction of the can shell, a plurality of recess-deformed portions arrayed both in the circumferential direction and axial direction on the outer wall of the can shell can be formed easily.

Moreover, by simply press-rolling the pressing member along the circumference wall of the can shell in a slantwise direction with respect to the circumferential direction of the can shell, a plurality of recess deformed portions that are arrayed spirally throughout a predetermined range in the axial direction of the can shell can be formed easily.

According to the method of the present invention, it is desirable that if the can shell is formed of aluminum with a thickness of 0.06 to 0.2 mm, the pressure of gas within the can shell is maintained at 0.1 to 0.5 MPa, and if the can shell is formed of steel with a thickness of 0.1 to 0.3 mm, the pressure of gas within the can shell is maintained at 0.1 to 0.7 MPa. This range has been clarified through various tests performed by the present inventors. It is common to use an aluminum can shell with a thickness of 0.06 to 0.2 mm, and to use a steel can shell with a thickness of 0.1 to 0.3 mm, but in such range of thickness, the pressure of gas applied to the interior of the can shell of both the aluminum can shell and the steel can shell should be 0.1 MPa or greater to maintain the can shape when the pressing member is pressed against the can shell and to form a recess-deformed portion reliably, and to prevent the occurrence of a collapse deformation in which the can shape cannot be maintained when forming the recess-deformed portion to the can shell. Further, the pressure applied to the aluminum can shell should be set to 0.5 MPa or smaller and the pressure applied to the steel can shell should be set to 0.7 MPa or smaller, in order to form an excellent recess-deformed portion while preventing the occurrence of excessive expansion or cracks on the can shell. Accordingly, the recess-deformed portion can be formed reliably to the can shell by maintaining the above-mentioned gas pressure based on the material of the can shell.

Moreover, if the pressing member is equipped with plural projections of predetermined shapes, the above-mentioned gas pressure is maintained as above according to the material of the can shell, and during the press molding step, it is preferable that the recess depth of the projections of the pressing member is 0.1 to 1.2 mm from the outer surface of the peripheral wall of the can shell toward the interior of the can shell, and wherein each of the projections on the pressing member has a projection height greater than the recess depth and disposed at intervals greater than 1 mm, and has a tip shape with a radius of curvature of 1 to 3 mm in a cross-sectional shape taken along the axial line of the pressing member.

The present inventors have discovered that upon recess-deforming the outer wall of the can shell with projections on the pressing member, the interval between the projections and the tip shape of the projections on the pressing member should be set within the above-mentioned range to form recess-deformed portions with excellent appearance that can be visually confirmed without fail even if the amount of deformation is relatively small. That is, according to various tests performed by the present inventors, recess-deformation of the can shell cannot be confirmed if the recess depth of the projections to the can shell is shallower than 0.1 mm, and recess-deformation can be sufficiently visually confirmed when the recess depth is 0.1 mm or deeper. Further, since predetermined pressure is applied by gas to the interior of the can shell, it has been discovered that even if the recess depth of the projections to the can shell exceeds 1.2 mm, the pushback by the inner pressure of the can shell causes the recess-deformed portions on the can shell to hardly change its depths, so recess-deformed portions with sufficient depths can be formed without having the projections reach unnecessarily deep recess depths. Furthermore, it has been discovered that when the recess depth is set between 0.1 to 1.2 mm, if the interval between the projections on the pressing member is narrower than 1 mm, the mutually adjacent recess-deformed portions will be formed continuously, so by setting the interval between projections to 1 mm or greater, it is possible to form plural recess-deformed portions that are visually confirmable to be formed independently. Further, as for the cross-sectional shape of the tip of the projections along the axis of the pressing member, if the radius of curvature of the tip is smaller than 1 mm, the projections become excessively sharp, and may cause scratches or punctures to be formed on the can shell. On the other hand, it has been discovered that if the tip of each projection has a radius of curvature greater than 3 mm when the recess depth is in the range of 0.1 to 1.2 mm, the recess-deformation of the can shell becomes insufficient, so by setting the radius of curvature of the tip of each projection to be 3 mm or smaller, it is possible to form recess-deformed portions that can be visually confirmed without fail. Further at this time, by setting the projection height of each projection on the pressing member to be greater than the recess depth, it becomes possible to form sufficient recess-deformed portions on the can shell being pressed by the tip of the projections.

Further, since predetermined pressure is applied by gas to the interior of the can shell, the projections on the pressing member are capable of providing an extremely shallow and subtle deformation on the peripheral wall of the can shell, and actually, capable of forming recess-deformed portions that can be visually confirmed reliably even if the amount of deformation of each recess-deformed portion is small. According to this method, the strength of the can shell will not be deteriorated, and at the same time, a three-dimensional pattern having a strong presence and a great appearance can be formed. Moreover, by forming recess-deformed portions with subtle deformation on the can shell, even when product indication etc. are printed on the surface of the can shell, the three-dimensional pattern will not deteriorate the visibility of the print.

Further, the device of the present invention realizes the methods of the present invention described earlier, and characterizes in comprising a can shell retention means for retaining in an exposed state an outer surface of a peripheral wall of the can shell having its interior maintained at predetermined pressure by gas, a pressing member disposed movably in directions pressing against or moving away from the peripheral wall of the can shell being retained by the can shell retention means, and a pressurizing means for pressing the pressing member against the peripheral wall of the can shell and recess-deforming the peripheral wall of the can shell into a predetermined shape.

According to the present device, the can shell retention means retains the can shell maintained at predetermined pressure by gas, and the pressurizing means presses the pressing member against the peripheral wall of the can shell. Thus, the peripheral wall of the can shell can be recessed accurately to the desired shape without having to insert a receive mold to the interior of the can shell as in the prior art, and outer shape processing can be provided reliably by a simple device configuration.

Further according to the present device, it is preferable that the can shell retention means comprises a pair of retention members that contact both ends of the can shell in the axial direction to thereby grip the can shell and retain the can shell with the interior of the can shell sealed, and a gas inlet means for introducing gas into the interior of the can shell through a gas inlet formed to at least one of the retention members of the can shell retention means and maintaining the interior of the can shell at predetermined pressure by gas.

Accordingly, gas is introduced to the interior of the can shell through a gas inlet provided to at least one of the retention members, so outer shape processing can be provided easily not only to can shells having both ends opened, but also to a can shell so-called a three-piece can shell in which one end is opened and the other end has a can lid crimped thereto, or to a two-piece can shell in which the bottom portion and the can shell are formed integrally.

According to the device of the present invention, the can shell retention means has both the retention members rotatably disposed and comprises a rotary drive means that rotates the can shell around its axis through at least one of the retention members, and the pressing member is formed in the shape of a roller and disposed rotatably with a circumference portion thereof pressed against the outer wall of the can shell.

Thereby, the whole circumference of the peripheral wall of the can shell can be recessed by simply rotating the can shell by a rotary drive means with the pressing member pressed against the outer wall of the can shell, and outer shape processing can be provided to the can shell extremely efficiently with a simple device configuration.

Further, the device of the present invention characterizes in that a moving means for moving the pressing member along the axis of the can shell is provided. Accordingly, relatively wide recess-deformation can be formed to the can shell by moving the pressing member by the moving means along the axial line of the can shell while rotating the can shell by the rotary drive means and pressing the roller-shaped pressing member against the can shell. Further, while maintaining the rotating state of the can shell by the rotary drive means, pressing the roller-shaped pressing member against the can shell, then removing the pressing member from the can shell, moving the pressing member for a predetermined distance along the axis of the can shell by the moving means and then pressing the pressing member against the can shell and repeating the same process, it is possible to form plural arrays of recess-deformed portions at predetermined intervals in the axial direction of the can shell extremely easily.

At this time, by having the pressing member supported rotatably slantwise with respect to the circumferential direction of the can shell, rotating the can shell by the rotary drive means and having the pressurizing means press the pressing member against the outer wall of the can shell, the moving means can simply move the pressing member to form a spiral recess-deformed portion on the outer wall of the can shell.

Further, since the pressing member is rotatable, by disposing on an outer circumference of the pressing member plural projections having predetermined shapes at predetermined intervals in the circumferential direction of the pressing member, plural recess-deformed portions can be formed at predetermined intervals on the whole circumference of the peripheral wall of the can shell by simply rotating the can shell by the rotary drive means while pressing the pressing member against the outer wall of the can shell.

Moreover, according to the present invention, it is preferable that the pressing member is equipped with a rotary drive means for rotating the pressing member in synchronism with the can shell retained by the can shell retention means. When a non-rotating pressing member is pressed against the peripheral wall of the rotating can shell, a delay in timing occurs from the time the pressing member contacts the can shell to the starting of rotation of the member along with the rotation of the can shell, which may cause the projections to scrape against the peripheral wall of the can shell and to not form the desired recess-deformed portion. Therefore, by providing a rotary drive means and rotating the pressing member in synchronism with the can shell, the projections on the pressing member can be pressed against the can shell without being delayed from the rotation of the can shell, forming recess-deformed portions infallibly on the peripheral wall of the can shell.

At this time, according to one aspect of the rotary drive means of the pressing member, the rotary drive means of the pressing member is equipped with a drive pulley disposed concentrically with at least one of the retention members, an idle pulley spaced from the drive pulley and having a belt suspended around the idle pulley and the drive pulley, and a pressurizing pulley pressed against the belt and rotates following the movement of the belt, and the pressurizing means maintains the pressurized state of the pressurizing pulley against the belt and moves the pressing member in directions pressing against or moving away from the peripheral wall of the can shell.

By designing the rotary drive means as above, at first, the rotation of the retention member causes the drive pulley to rotate in synchronism with the can shell. By the rotation of the drive pulley, the belt suspended around the idle pulley and the drive pulley is rotated. The pressurizing pulley is pressed against the belt, and by the rotation of the belt the pressing means can be rotated via the pressurizing pulley. Further, the pressurizing pulley maintains the pressure to the belt even when the pressing member is moved in the directions pressing against or moving away from the peripheral wall of the can shell, so that when the pressing member is pressed against the peripheral wall of the can shell by the pressurizing means, the pressing member can be rotated in synchronism with the can shell.

Further at this time, a moving means is provided to move the pressing member along the axis of the can shell and the pressurizing pulley is formed to have a pressurizing surface for pressing against the belt with a width corresponding to a distance that the pressing member moves by the moving means. When the pressing member is moved along the axis of the can shell by the moving means, the belt can move relatively along the pressing surface of the pressurizing pulley while maintaining the pressurized state against the pressurizing pulley. Thus, even when the pressing member is moved along the axis of the can shell, the pressing member can be rotated in synchronism with the can shell.

BEST MODE FOR CARRYING OUT THE INVENTION

Figure 1:
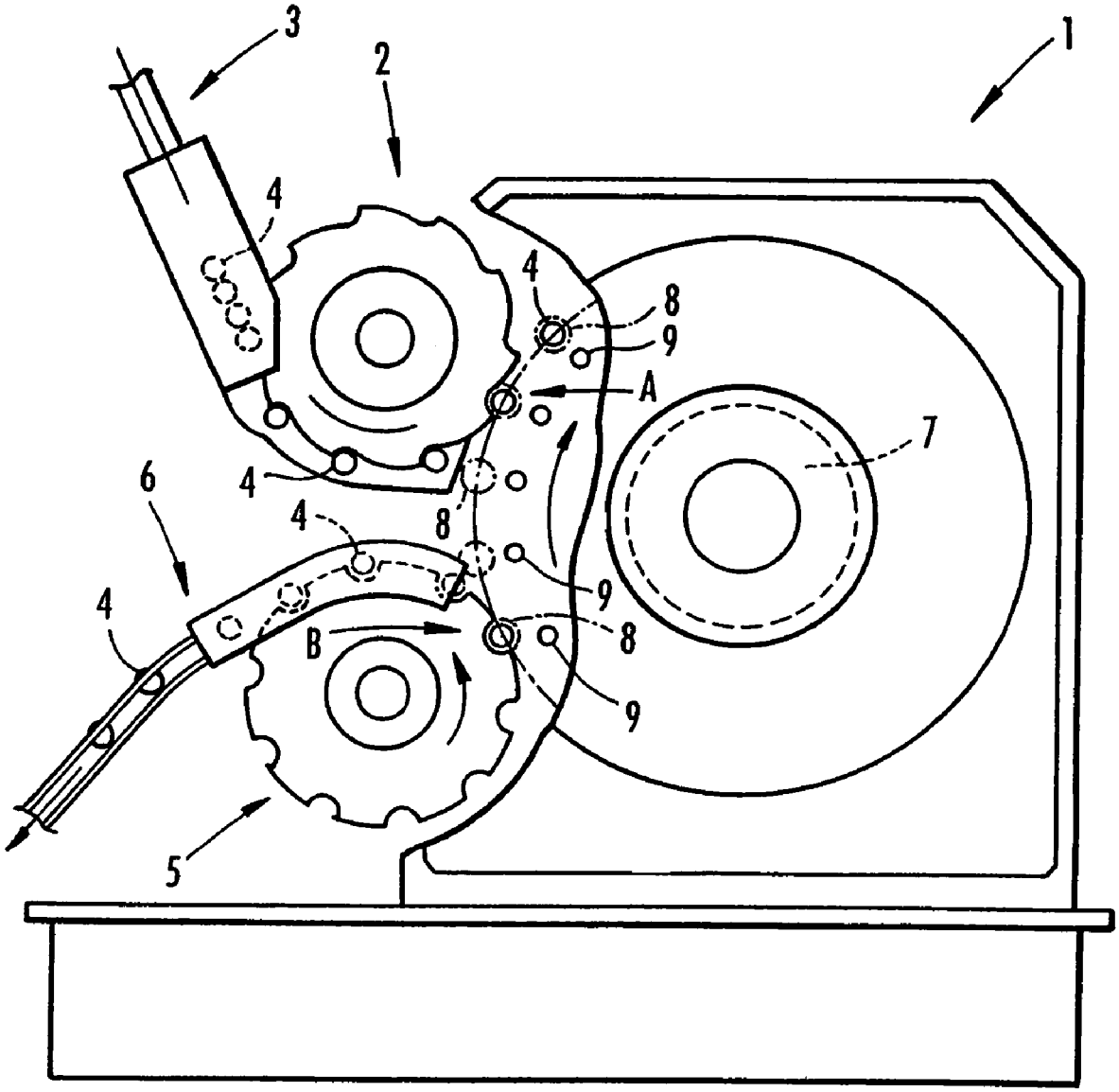
FIG. 1 is an explanatory side view showing the schematic structure of an embodiment device according to the present invention.

In FIG. 1, reference number 1 denotes an outer shape processing device, 2 denotes a charge turret for charging a can shell 4 into the outer shape processing device 1 from a charge path 3, and 5 denotes a discharge turret for discharging the can shell 4 from the outer shape processing device 1 to a discharge path 6. Though details will be described later, the outer shape processing device 1 is equipped with a plurality of can shell retention means 8 that rotate circumferentially around a rotary shaft 7 being rotated by a rotary drive means not shown, and pressing members 9 that are pressed against the peripheral wall of the can shell 4 retained by the can shell retention means 8 to provide outer shape processing to the can shell 4. The charge turret 2 individually vacuums up and retains the can shell 4 being fed through the charge path 3 and hands it over to the can shell retention means 8 at charge position A. The discharge turret 5 sucks in the can shell 4 retained by the can shell retention means 8 and subjected to outer shape processing at discharge position B, and sends it out toward the discharge path 6.

Figure 2:
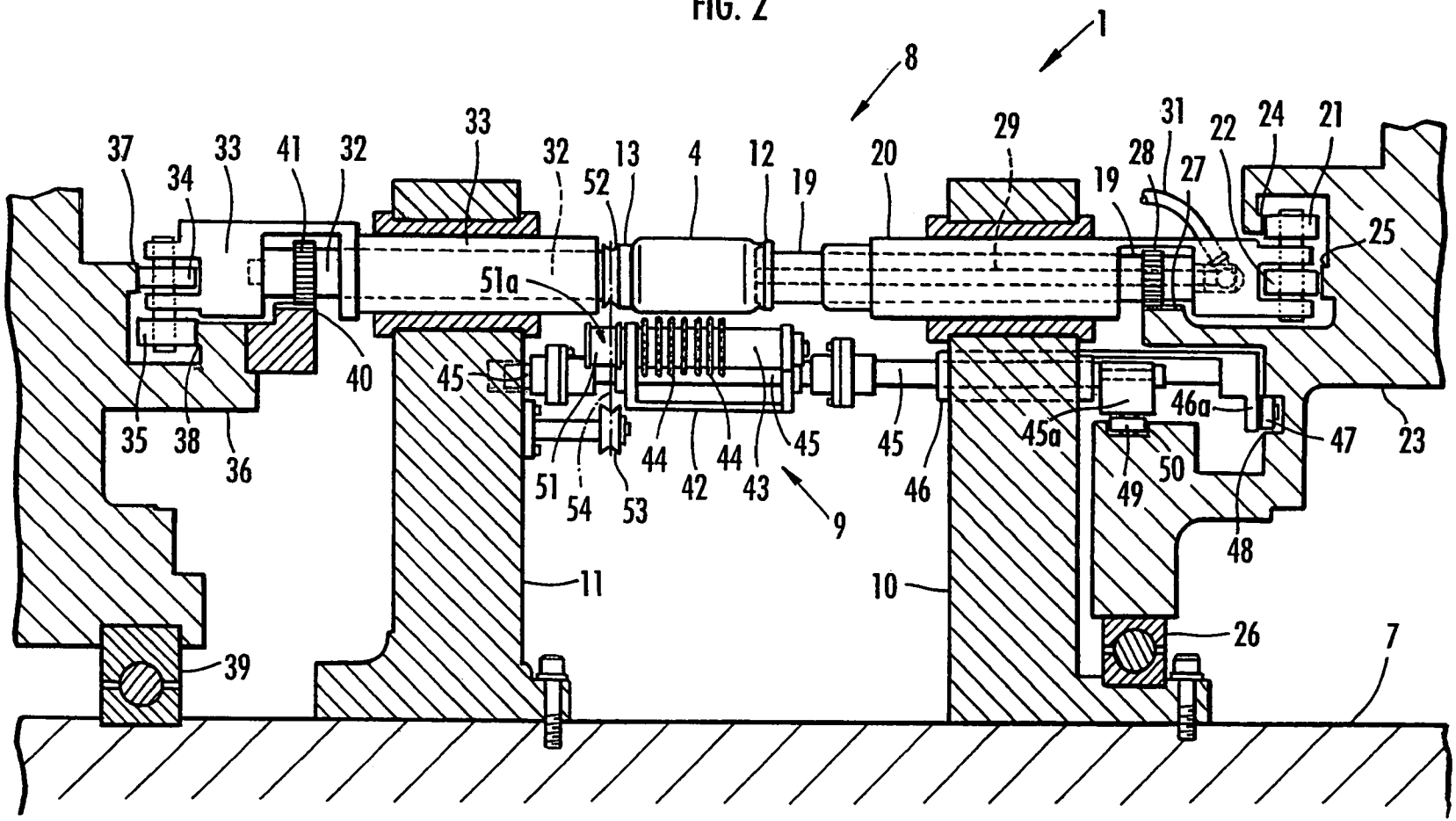
FIG. 2 is an explanatory cross-sectional view showing the main portion of the embodiment device according to the present invention.
Figure 3:
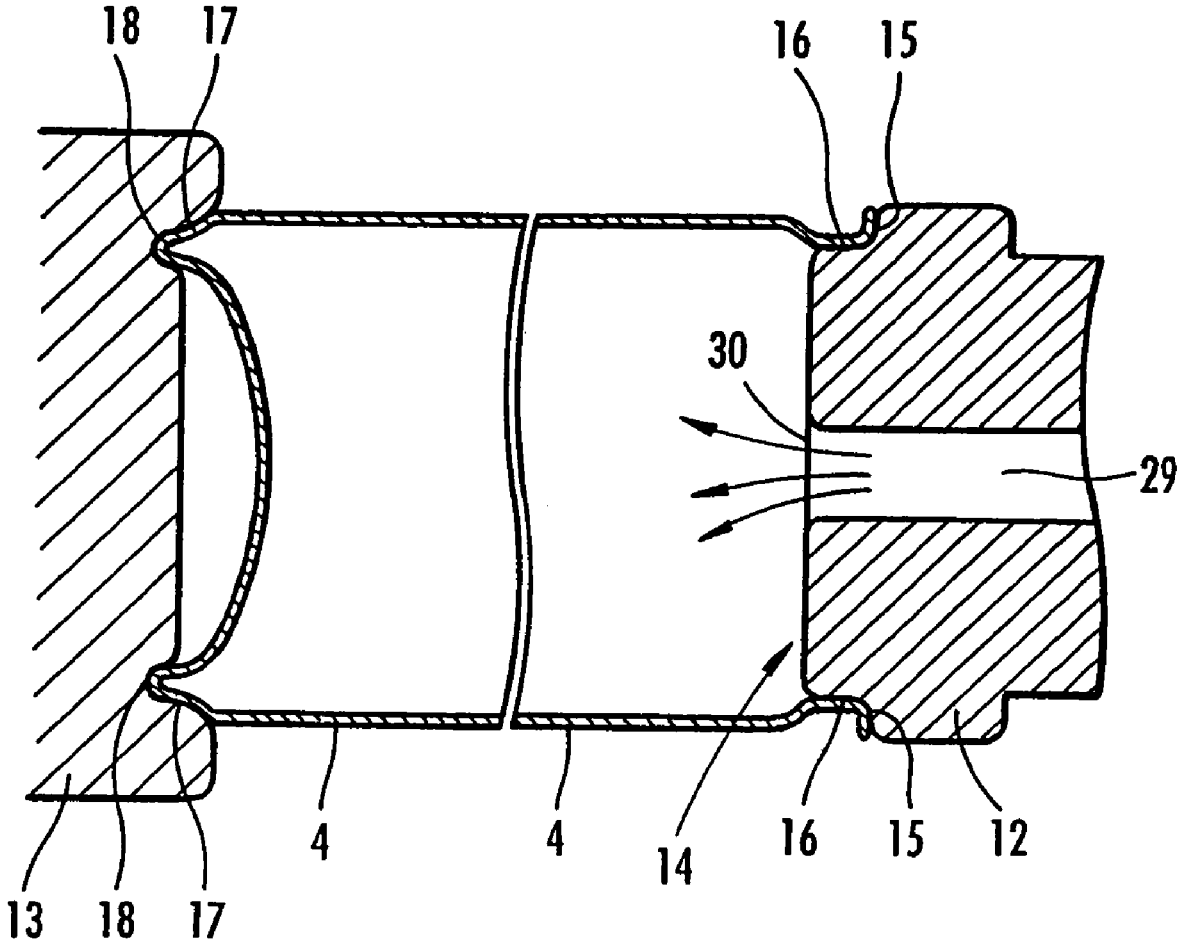
FIG. 3 is an explanatory view showing the retained status of the can shell by a retention member.

The outer shape processing device 1 is equipped with a pair of disk-shaped rotary support units 10 and 11 disposed in connection with the rotary shaft 7, as shown partially in cross-section in FIG. 2, and on the circumference portion of the rotary support units 10 and 11 are supported a plurality of can shell retention means 8 at predetermined intervals. The can shell retention means 8 is equipped with a first retention member 12 that comes into contact with one opened end of the cylindrically formed can shell 4, and a second retention member 13 disposed opposite to the first retention member 12 and comes into contact with the other end of the can shell 4 that is closed. As shown in FIG. 3, the first retention member 12 is equipped with a contact portion 16 having a shape corresponding to a flange portion 15 formed to the circumference of an opening 14 of the can shell 4 so as to contact the flange portion 15 in an airtight manner. The second retention member 13 is equipped with a contact portion 18 having a shape corresponding to a closed bottom portion 17 of the can shell 4 and contacts the bottom portion 17. In the present embodiment, the can shell 4 being subjected to outer shape processing is made of relatively thin aluminum, and forms a so-called two-piece can in which a can lid not shown is crimped tightly onto the opening 14.

As shown in FIG. 2, the first retention member 12 is disposed at a tip of a first rotary shaft 19. The first rotary shaft 19 is supported rotatably by a first movable member 20 supported movably in the advancing and retrieving directions on one of the rotary support units 10. The first movable member 20 is equipped with a pair of first cam rollers 21 and 22 at the rear end thereof. The first cam rollers 21 and 22 are guided by first cam rails 24 and 25 formed to a first guide frame 23 disposed annularly along the outer side of the rotary shaft 7, and by this guide the first movable member 20 is moved in the advancing and retrieving directions. The first guide frame 23 rotatably supports a portion of the rotary shaft 7 via a bearing 26. The first guide frame 23 is provided with an annular first drive gear 27, and the first rotary shaft 19 is equipped with a first driven gear 28 that engages with the first drive gear 27. Thereby, accompanying the rotation of the rotary shaft 7, the first drive gear 27 drives via the first driven gear 28 the first rotary shaft 19 and first retention member 12 to rotate. Further, accompanying the rotation of the rotary shaft 7, the first cam rollers 21 and 22 are guided by the first cam rails 24 and 25. Thereby, at charge position A (shown in FIG. 1) the first movable member 20 moves the first rotary shaft 19 and the first retention member 12 to advance toward the can shell 4, and at discharge position B (shown in FIG. 1) the first movable member 20 moves the first rotary shaft 19 and the first retention member 12 to retrieve in the direction moving away from the can shell 4.

Furthermore, the first retention member 12 is equipped with an air inlet 30 where one end of an air flow passage 29 formed along the axis of the first rotary shaft 19 and the first movable member 20 is opened. The air flow passage 29 has an air supply means (gas introduction means) not shown connected thereto via a connecting tube 31 extending from the rear of the first movable member 20, and as shown in FIG. 3, air having predetermined pressure is introduced to the interior of the can shell 4 through the air inlet 30 so as to maintain the interior of the can shell 4 at predetermined pressure.

The second retention member 13 is disposed at the tip of a second rotary shaft 32, as shown in FIG. 2. The second rotary shaft 32 is supported rotatably by a second movable member 33 supported movably in the advancing and retrieving directions on the other rotary support unit 11. At the rear end of the second movable member 33 is provided a pair of second cam rollers 34 and 35. The second cam rollers 34 and 35 are guided by second cam rails 37 and 38 formed to a second guide frame 36 disposed annularly along the outer side of the rotary shaft 7, and by this guide the second movable member 33 is moved in the advancing and retrieving directions. The second guide frame 36 rotatably supports a portion of the rotary shaft 7 via a bearing 39. The second guide frame 36 is provided with an annular second drive gear 40, and the second rotary shaft 32 is equipped with a second driven gear 41 that engages with the second drive gear 40. Thereby, accompanying the rotation of the rotary shaft 7, the second drive gear 40 drives via the second driven gear 41 the second rotary shaft 32 and second retention member 13 to rotate. Further, accompanying the rotation of the rotary shaft 7, the second cam rails 37 and 38 guide the second cam rollers 34 and 35. Thereby, at charge position A (shown in FIG. 1) the second movable member 33 moves the second rotary shaft 32 and the second retention member 13 to advance toward the can shell 4, and at discharge position B (shown in FIG. 1) the second movable member 33 moves the second rotary shaft 32 and the second retention member 13 to retrieve in the direction moving away from the can shell 4.

Further, the pressing member 9 is disposed between both rotary support members 10 and 11. The pressing member 9 is equipped with a bracket 42, a rotary shaft 43 rotatably supported on the bracket 42, and plural (seven in the present embodiment) pressing members 44 supported on the rotary shaft 43 at predetermined intervals. The bracket 42 is connected integrally to a support shaft 45. The support shaft 45 is rotatably and axially slidably supported by the rotary support units 10 and 11. In further detail, a portion of the support shaft 45 is supported via a cylindrical member 46 by the rotary support unit 10. The cylindrical member 46 is rotatably supported by the rotary support unit 10. The support shaft 45 is slidably inserted to the cylindrical member 46 and also designed to rotate together with the cylindrical member 46. A pivot arm **46*a* is connected to the rear end of the cylindrical member 46, and on the pivot arm 46*a* is disposed a third cam roller 47**.

Further, at the rear end of the support shaft 45 is disposed a moving block **45*a* to which the support shaft 45 is rotatably inserted, which can move together with the support shaft 45 in the axial direction. The moving block 45*a* is provided with a fourth cam roller 49**.

The third cam roller 47 is guided by a third cam rail 48 formed to the first guide frame 23. The third cam roller 47 rotates the cylindrical member 46 and support shaft 45 via the pivot arm **46*a* by guidance of the third cam rail 48, and pivots the bracket 42 connected to the support shaft 45 to press the pressing member 44 against the can shell 4. The support shaft 45, the cylindrical member 46, the pivot arm 46*a*, the third cam roller 47 and the third cam rail 48** constitute the pressurizing means of the present invention.

The fourth cam roller 49 is guided by a fourth cam rail 50 formed to the first guide frame 23. The fourth cam roller 49 moves the moving block **45*a* in the right direction of the drawing by guidance of the fourth cam rail 50, moves the support shaft 45 in the axial direction thereof, and also moves the pressing member 44 in the axial direction of the can shell 4 via the bracket 42 connected to the support shaft 45. The moving block 45*a*, the fourth cam roller 49 and the fourth cam rail 50** constitute the moving means of the present invention.

Furthermore, the pressing means 9 is equipped with a pressurizing pulley 51 on the rotary shaft 43 supported by the bracket 42. The pressurizing pulley 51 is pressed against a belt 54 suspended around a drive pulley 52 provided to the second retention member 13 and an idle pulley 53 rotatably supported by the other rotary support unit 11, and as mentioned in detail later, rotates in synchronism with the second retention member 13 and capable of being pivoted. The pressurizing pulley 51 is equipped with a pressurizing surface 51*a* having a width size corresponding to the moving distance of the pressing member 44 so as to maintain pressure to the belt 54 even when the bracket 42 and the pressing member 44 are moved in the axial direction of the can shell 4.

Figure 4:
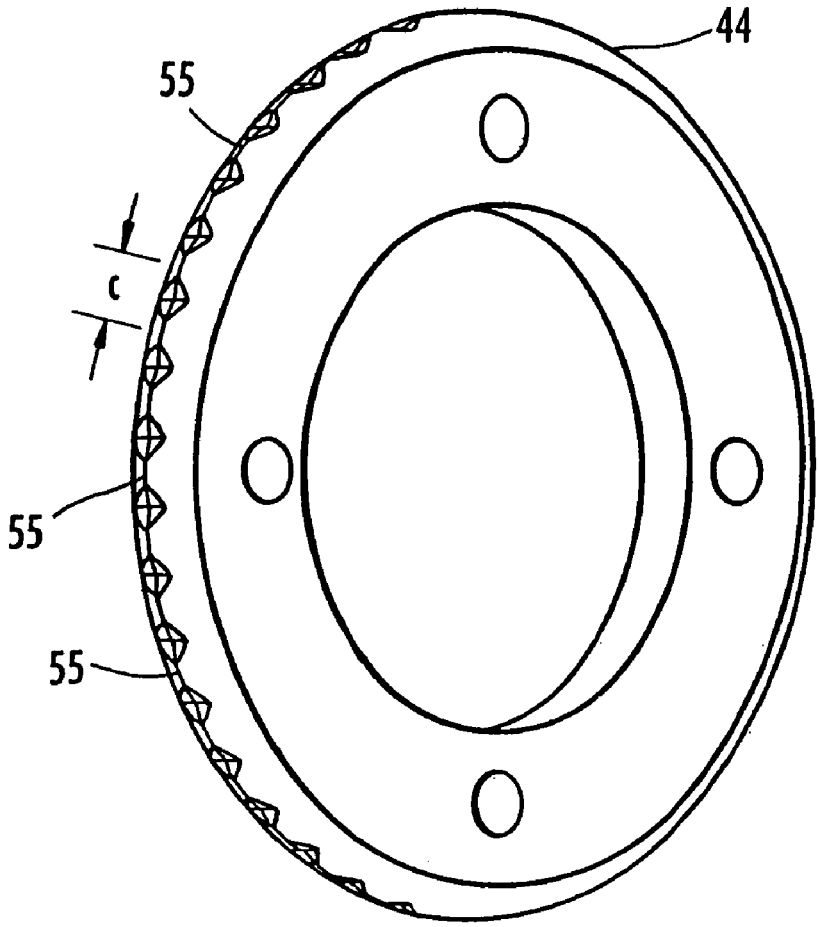
FIG. 4 is an explanatory perspective view showing a pressing member and its projected portion.
Figure 4:
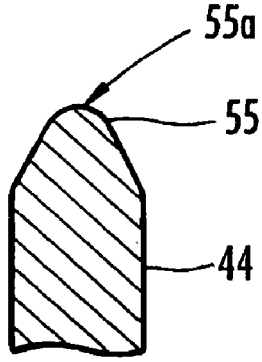

The pressing member 44 is formed in a disk-like shape as shown in FIG. 4(*a*), and a plurality of projections 55 are formed at predetermined intervals on the circumference thereof. Each projection 55 is formed so that a tip 55*a* has a radius of curvature of 3 mm in the cross-sectional shape taken along the axis of the pressing member 44, as shown in FIG. 4(*b*). Moreover, each projection 55 is formed so that its projected height is greater than 1.2 mm, and disposed at an interval of 1 mm. Further, although not shown, the pressing member 44 is supported by the bracket 42 in such a manner that its rotary shaft 43 is angled slightly slantwise (3 degrees, for example) against the axis of the can shell 4, so that the pressing member 44 is pressed against the circumferential direction of the can shell 4 with a slight slant.

Figure 5:
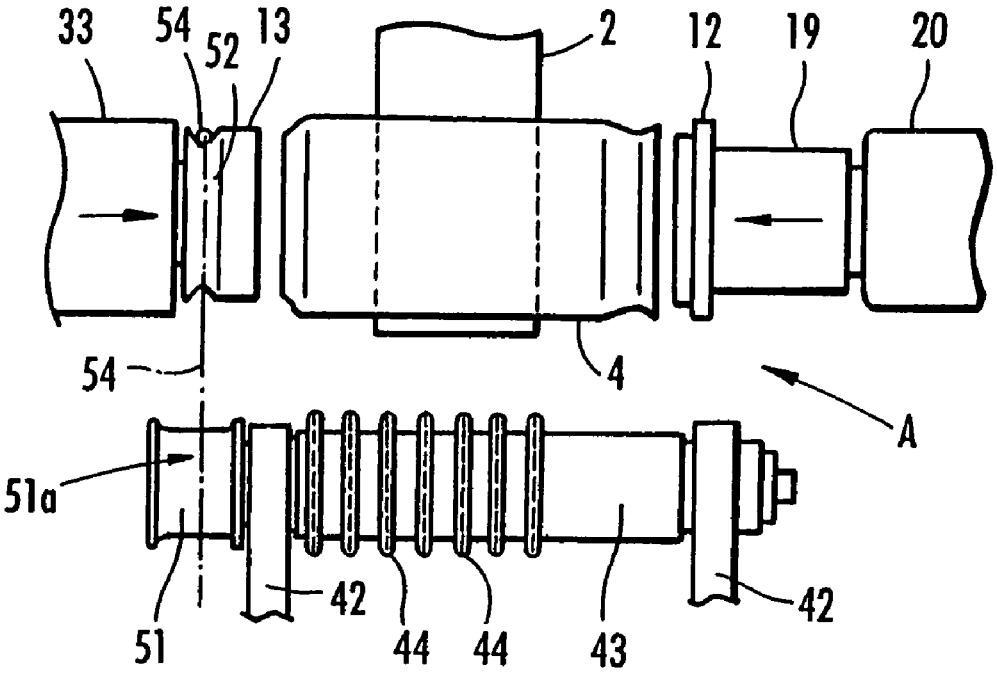
FIG. 5 is an explanatory view showing the operation of the embodiment device when a can shell is fed.
Figure 5:
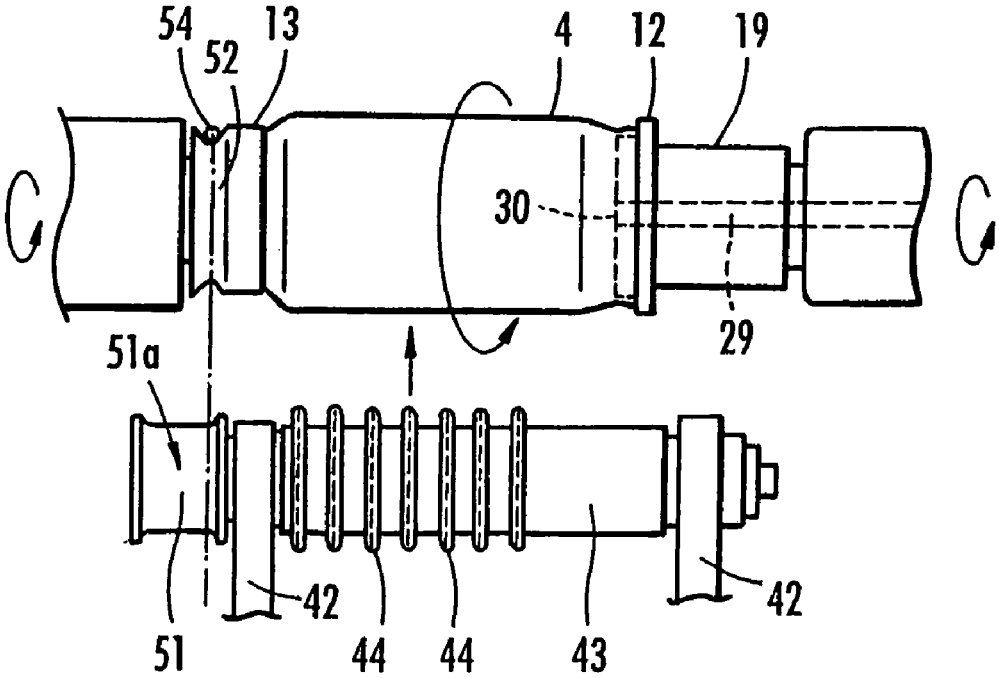

Next, the outer shape processing of the can shell performed by the outer shape processing device 1 according to the present invention will be explained. First, with reference to FIG. 1, the can shell 4 fed continuously along the charging path 3 is retained by the charge turret 2 and then retained by the can shell retention means 8 at charge position A. At this time, at charge position A, the first retention member 12 and the second retention member 13 are retrieved in the directions separating from each other as shown in FIG. 5(*a*), and the can shell 4 retained by the charge turret 2 is positioned between the first retention member 12 and the second retention member 13. Next, as shown in FIG. 5(*b*), the first retention member 12 and the second retention member 13 are advanced in the directions approaching one another, and the can shell 4 is sandwiched between the first retention member 12 and second retention member 13 (can shell retaining step). In this state, the outer surface of the peripheral wall of the can shell 4 is in exposed state. Further, as shown in FIG. 3, the contact portion 16 of the first retention member 12 contacts the flange portion 15 of the opening 14 of the can shell 4 in an airtight manner, and the contact portion 18 of the second retention member 13 contacts the bottom portion 17 of the can shell 4. At this time, as shown in FIG. 5(*b*), since the first retention member 12 and second retention member 13 are rotated, the can shell 4 held between the first retention member 12 and second retention member 13 is rotated.

Next, as shown in FIG. 3, while maintaining the retention state of the can shell 4 by the first retention member 12 and second retention member 13, air is introduced to the interior of the can shell 4 from the air inlet 30 provided to the first retention member 12 and the air pressure in the interior of the can shell 4 is maintained at predetermined pressure (gas introduction step). The air pressure in the interior of the can shell is maintained at 0.1 to 0.5 MPa when the can shell 4 is formed of an aluminum having a thickness of 0.06 to 0.2 mm.

Figure 6:
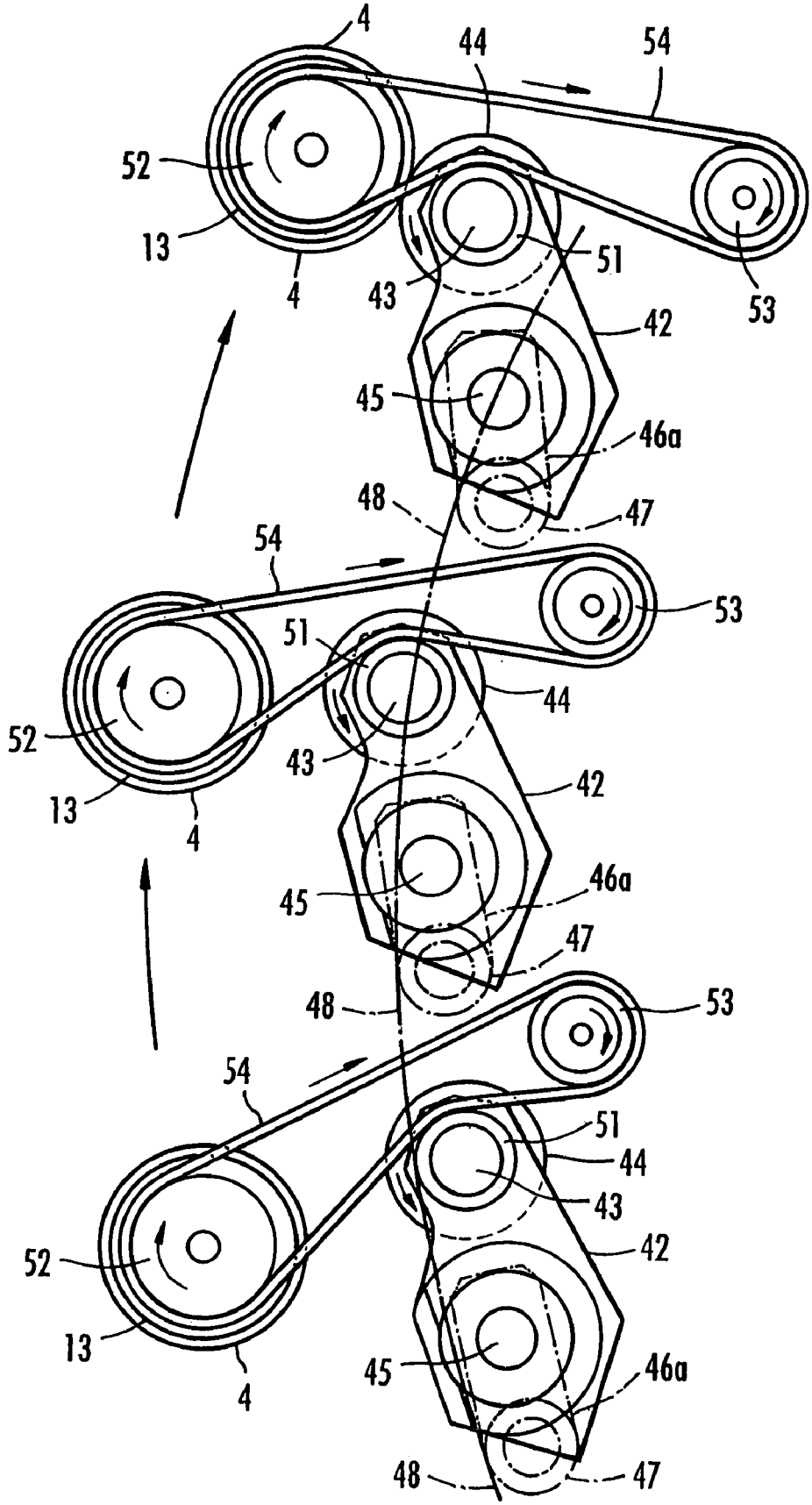
FIG. 6 is an explanatory view showing the operation of a pressurizing means.
Figure 7:
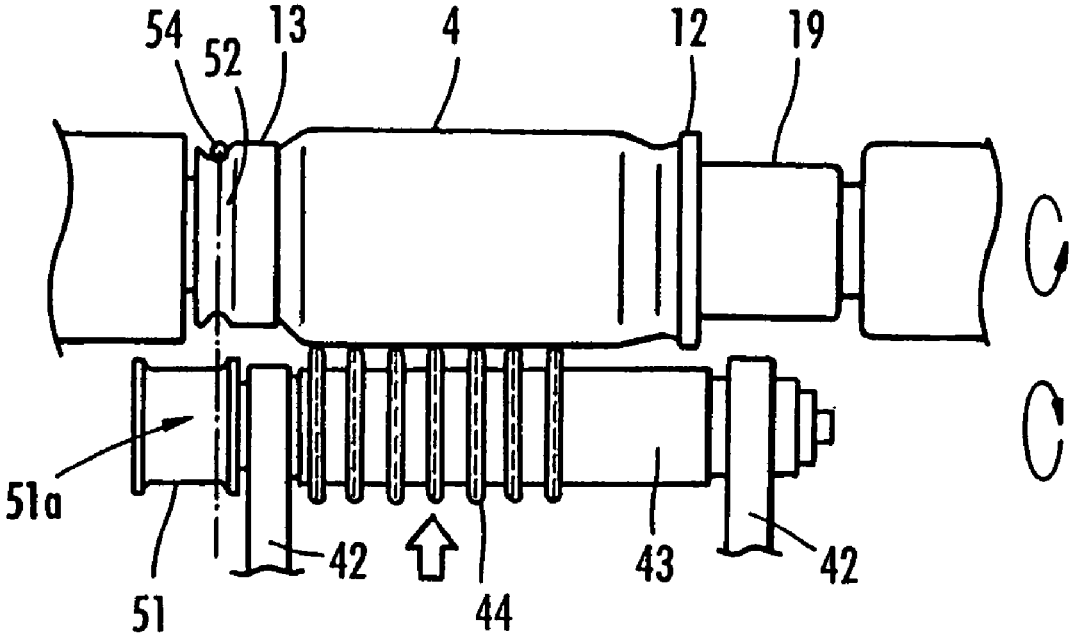
FIG. 7 is an explanatory view showing the operation when outer shape processing is provided to the can shell.
Figure 7:
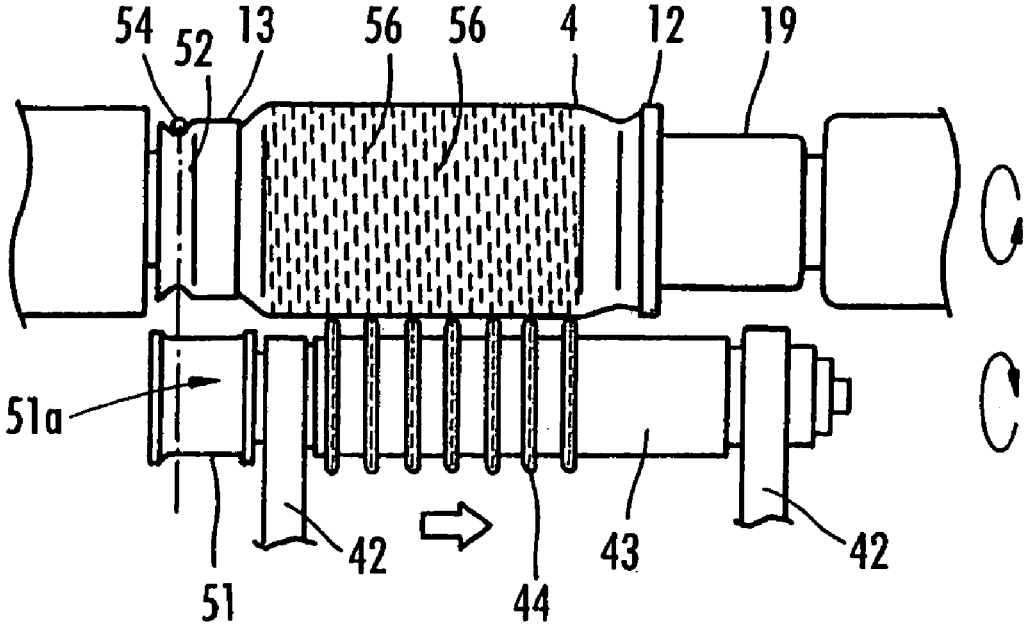

Next, as shown in FIG. 6, the pressing member 44 is pressed against the can shell 4. In other words, the pressing member 44 is pressed against the can shell 4 by the third cam roller 47 of pivot arm 46*a* extending from the cylindrical member 46 being guided by the third cam rail 48 and the bracket 42 pivoting around the support shaft 45. At this time, following the rotation of the drive pulley 52 and idle pulley 53, the rotation of the pressing member 44 is maintained via the pressurizing pulley 51. Then, as shown in FIG. 7(*a*), by the pressing members 44 being pressed against the can shell 4, recess-deformed portions 56 are formed on the outer wall of the can shell 4 by the projections 55 on the pressing members 44, as illustrated in enlarged cross-section in FIG. 8(*a*). The pressing member 44 is pressed against the outer surface of the peripheral wall of the can shell 4 toward the inner side of the can shell 4 until the recess size a of the projection 55 reaches 1.2 mm. The recess size a should be within the range of 0.1 to 1.2 mm to form a recess-deformed portion 56 having good appearance that can be sufficiently visually confirmed.

Furthermore, as shown in FIG. 7(*b*), the pressing member 44 is moved along the axial direction of the can shell 4. The movement of the pressing member 44 at this time is performed by the fourth cam rail 50 guiding the fourth cam roller 49, as described before with reference to FIG. 2. That is, when the fourth cam roller 49 is moved toward the right direction of FIG. 2 by the fourth cam rail 50, the support shaft 45 is moved in the axial direction via the moving block 45*a*. Thus, the bracket 42 is moved together with the support shaft 45, and the pressing member 44 is moved along the axial direction of the can shell 4.

Figure 8:
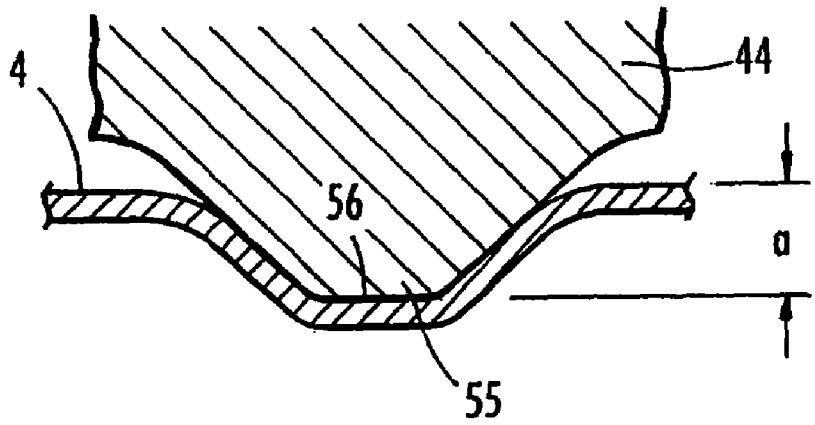
FIG. 8 is an explanatory view showing the press molding process and the recess-deformed portion of the can shell.
Figure 8:
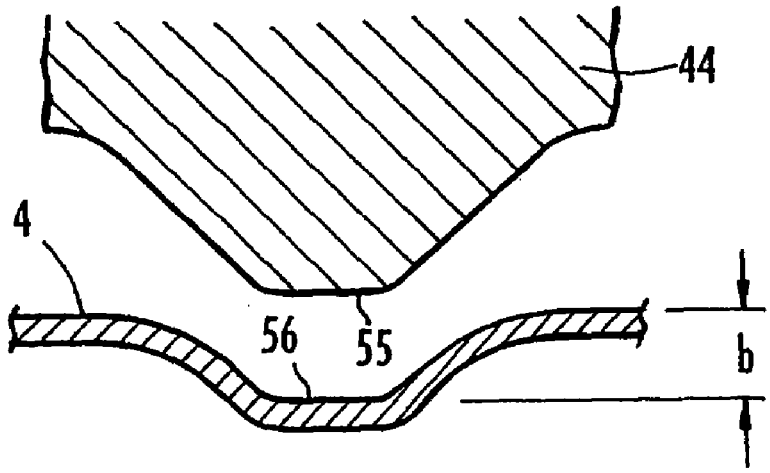

Since the pressing member 44 is rolled slantwise against the circumferential direction of the can shell 4, a plurality of recess-deformed portions 56 that are arrayed spirally are formed on the outer wall of the can shell 4. Each recess-deformed portion 56 has a depth size b that is slightly shallower than recess size a due to the removal of the projection 55 and the pushback of the air pressure within the can shell 4, as shown in FIG. 8(*b*). Therefore, if the recess size a formed by projection 55 in FIG. 8(*a*) is smaller than 0.1 mm, it can hardly be visually confirmed, but if the recess size a formed by projection 55 is greater than 0.1 mm, it can be confirmed visually without fail. The interval c between projections 55 shown in FIG. 4(*a*) should be equal to or greater than 1 mm, and the tip 55*a* of the projection 55 shown in FIG. 4(*b*) should preferably have a radius of curvature of 1 to 3 mm.

Figure 9:
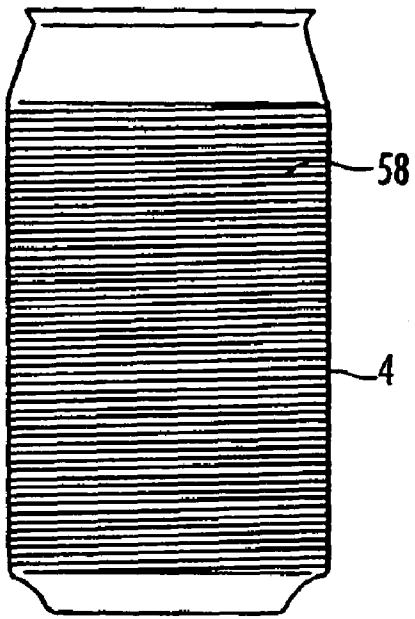
FIG. 9 is an explanatory view showing can shells formed using other pressing members.
Figure 9:
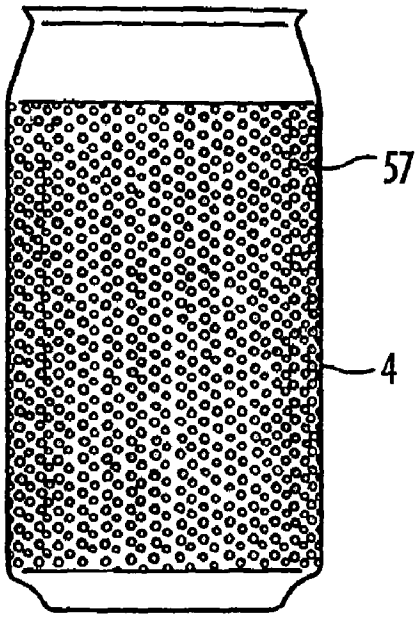
Figure 9:
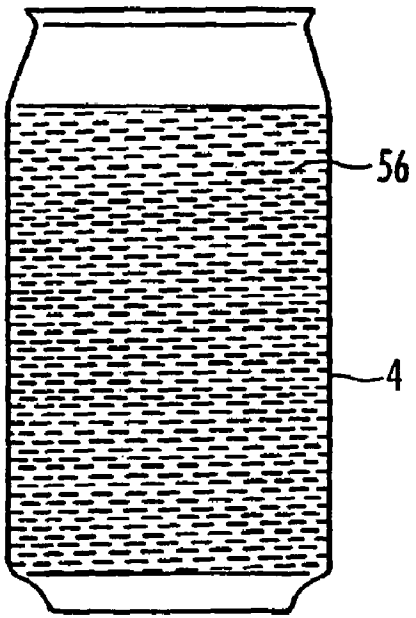

When the outer wall of the can shell 4 is recess-deformed by the projections 55 on the pressing member 44, the interval between the projections 55 on the pressing member 44 or the tip shape of the projections can be changed to form other recess-deformed portions having good appearances. FIG. 9(*a*) shows a can shell 4 having a recess-deformed portion 56 formed according to the present embodiment, but in comparison, through other pressing members are not illustrated, if the shape of the projections is substantially cone-shaped, a recess-deformed portion 57 as illustrated in FIG. 9(*b*) can be formed. Further, by forming a continuous projection on the outer circumference of the pressing member, a continuous linear recess-deformed portion 58 can be formed as illustrated in FIG. 9(*c*).

According to the present embodiment, as illustrated in FIG. 2, seven pressing members 44 are retained at predetermined intervals on the rotary shaft 43 by which the efficiency of outer shape processing is improved since the amount of movement of the pressing member 44 in the axial direction of the can shell 4 is small, but the number of pressing members 44 can be increased or decreased according to the axial direction length of the can shell 4 (height of the can shell 4). Further, a similar recess-deformed portion 56 can be formed by having a single pressing member 44 retained on the rotary shaft 43 and elongating the amount of movement thereof. According further to the present embodiment, the rotary shaft 43 supporting the pressing member 44 was slanted to form plural recess-deformed portions 56 arranged spirally, but the rotary shaft 43 supporting the pressing member 44 can be disposed in parallel to the axis of the can shell 4. In such case, although not shown, recess-deformed portions arranged annularly along the outer circumference of the can shell 4 can be formed.

As described, according to the present embodiment, by introducing air having predetermined pressure to the interior of the can shell 4, recess-deformed portions 56 can be formed simply by pressing a pressing member 44 against the outer peripheral wall surface of the can shell. Thus, outer shape processing can be performed without having to insert a receive mold to the interior of the can shell 4 which was necessary in the prior art, so the outer shape processing can be provided to the can shell 4 without causing damage to the inner surface of the can shell 4 and with a simple device configuration.

Figure 10:
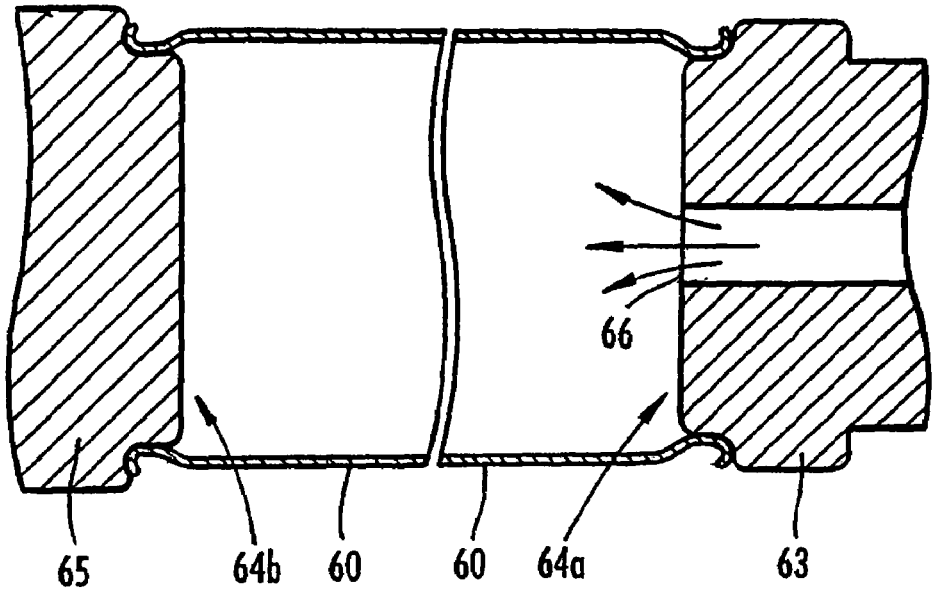
FIGS. 10 through 12 are explanatory views showing the retained status of can shells according to other retention members.
Figure 11:
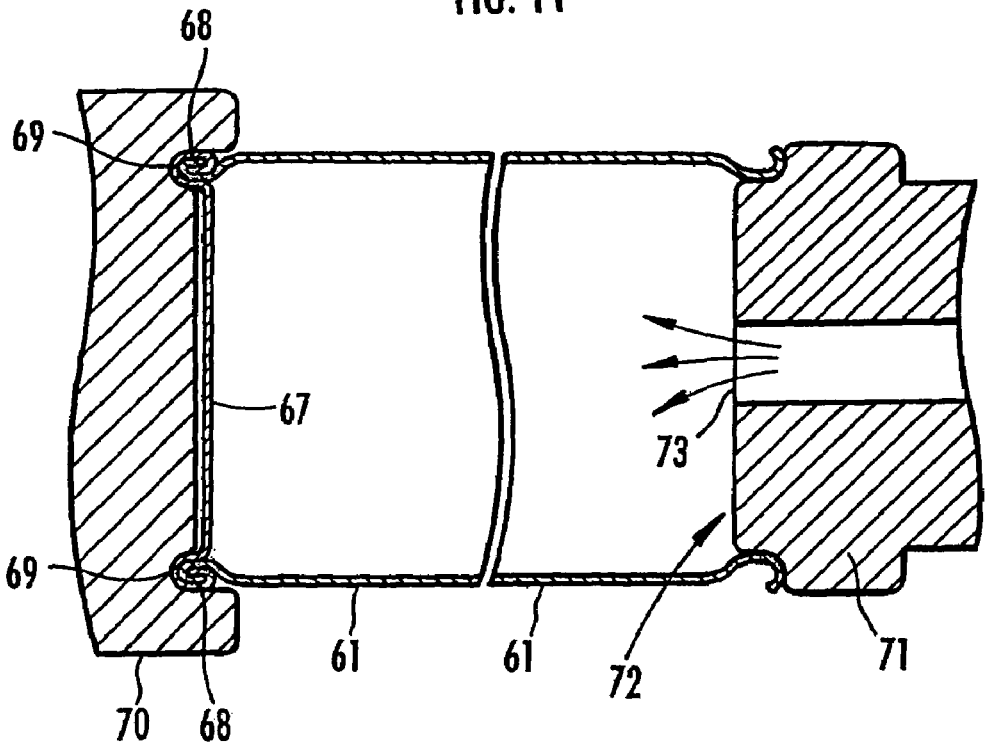
Figure 12:
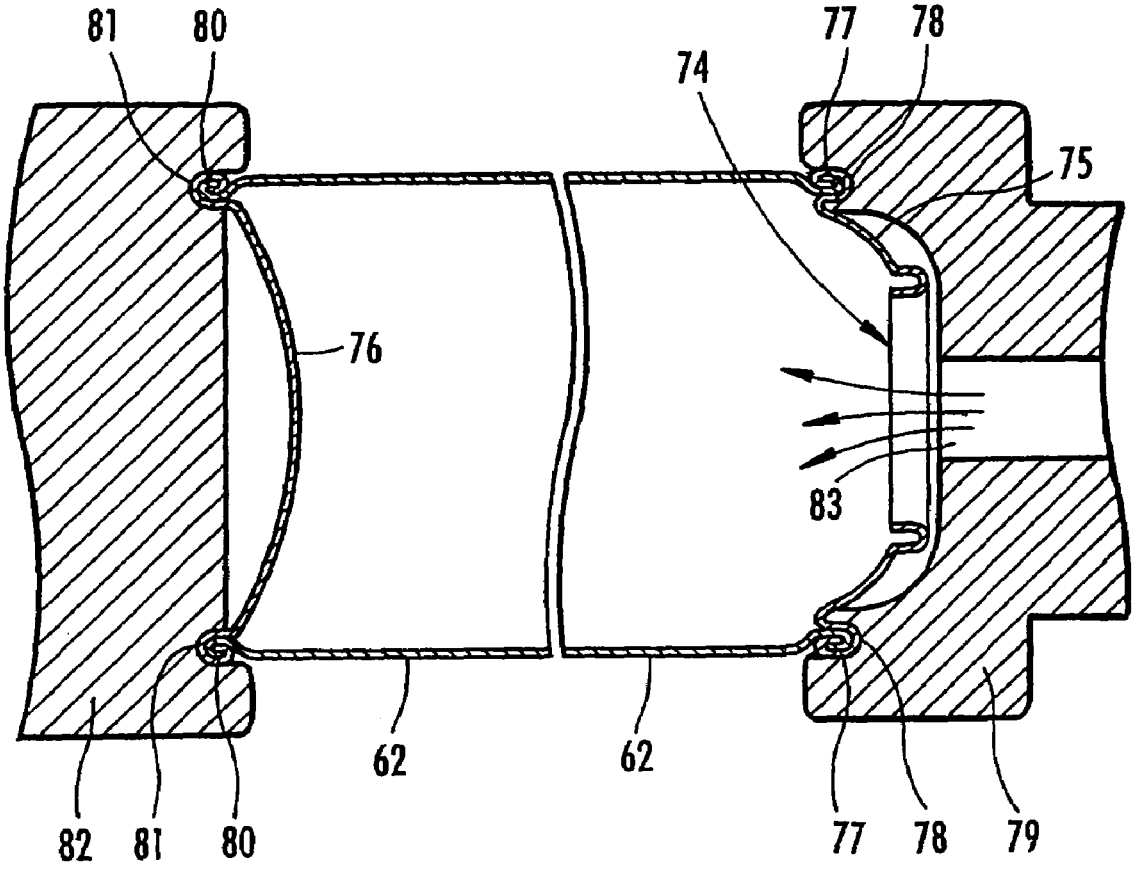

According to the present embodiment, as illustrated in FIG. 3, the method for providing outer shape processing to an aluminum can shell 4 of a so-called two-piece can was described, but the present method can be applied to other types of can shells 60, 61 and 62 illustrated in FIGS. 10 through 12. As illustrated in FIG. 10, if outer shape processing is to be provided to a can shell 60 of a so-called three-piece can made of steel having both ends opened, a first retention member 63 is placed to contact one opening 64*a* of the can shell 60 and a second retention member 65 is placed to contact the other opening 64*b* of the can shell 60, by which the can shell 60 is retained. Then, air is introduced to the interior of the can shell 60 from the opening 64*a* of the can shell 60 via an air inlet 66 of the first retention member 63. If the can shell 60 has a wall thickness of 0.1 to 0.3 mm, the air pressure within the can shell 60 is maintained at 0.1 to 0.7 MPa.

Further, as shown in FIG. 11, if outer shape processing is to be provided to a can shell 62 of a so-called three-piece can made of steel having a can lid 67 crimped tightly onto the other end, a second retention member 70 equipped with a contact portion 69 corresponding to the crimped portion 68 of the can lid 67 is disposed to retain the can shell 61 between a first retention member 71. Then, air is introduced to the interior of the can shell 61 from the opening 72 of the can shell 61 via an air inlet 73 of the first retention member 71.

Even further, if the object is a steel can shell 62 having an annular top lid 75 with an opening 74 formed to the center thereof crimped to one end and a dome-shaped bottom panel 76 crimped to the other end (for example, a can shell for an aerosol can), the can shell 62 is sandwiched by a first retention member 79 having a contact portion 78 corresponding to the shape of a crimped portion 77 of the top lid 75 and a second retention member 82 having a contact portion 81 corresponding to a crimped portion 80 of the bottom panel 77. Then, air should be introduced to the interior of the can shell 62 from the opening 74 of the annular top lid 75 via an air inlet 83 of the first retention member 79. Thus, according to the present invention, outer shape processing can be provided easily to various types of can shells 4, 60, 61 and 62.

Figure 13:
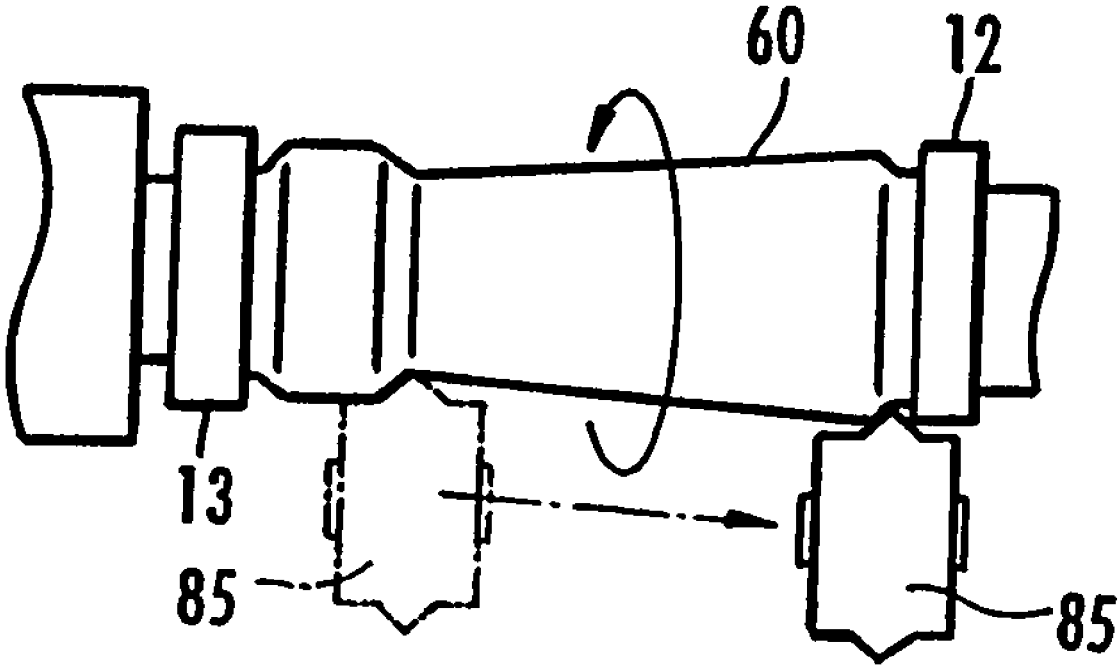
FIG. 13 is an explanatory view showing the press molding process using other pressing members.

Moreover, it is possible to form another different recess-deformed portion by applying the outer shape processing method of the present invention. That is, as shown in FIG. 13, the outer shape of the can shell 60 can be formed to have a tapered shape by moving the pressing roller 85 in the axial direction of the can shell 4 while maintaining the pressure pressing the peripheral wall by the pressing roller 85, and gradually reducing the pressing force of the pressing roller 85 during this movement.

The present embodiment illustrated examples for forming a recess-deformed portion by adopting a pressing member 44 or pressing roller 85 to press the outer wall of the can shell, but the present invention is not limited to these examples. Although not shown, a different shaft-like pressing member having a domed pressing surface formed to the tip, for example, can be provided in replacement of the pressing member 44 and the pressing roller 85, to form a recess to only a portion of the can shell.

According further to the present embodiment, as shown in FIG. 7(*b*), the can shell 4 was rotated around its axis when forming recess-deformed portions 56 to the whole circumference of the can shell 4, but as an alternative, although not shown, it is possible to rotate the pressing member 44 around the axis of the can shell 4 without rotating the can shell 4. Likewise, when forming recess-deformed portions 56 to the desired range, other than moving the pressing member 44 to the axial direction of the can shell 4, although not shown, the can shell 4 can be moved in the axial direction of the can shell 4 without moving the pressing member 44. Further, air was adopted as the gas to be introduced to the interior of the can shell 4 according to the present embodiment, but it is not limited thereto, and other gases such as nitrogen gas or carbon dioxide gas can be adopted. Moreover, even if gas and liquid are contained in the can shell, equivalent effects can be achieved if the gas provides predetermined pressure to the interior of the can shell.

INDUSTRIAL APPLICABILITY

The present invention can be adopted when processing the outer shape of a can shell to enable three-dimensional patterns of significant design performance to be provided at low cost on any type of can shell regardless of its shape, while preventing deterioration of strength of the can shell and reliably preventing damage of the inner surface of the can shell and deterioration of the coating thereof.

The invention claimed is:

1. A method for processing a can shell, said method comprising:

retaining the can shell with an outer surface of a peripheral wall of the can shell exposed and an interior of the can shell sealed; and pressing a circumferential portion of a rotatably disk-shaped pressing member against an outer surface of the peripheral wall of the can shell having its interior maintained at a predetermined pressure while rotating the pressing member and the can shell so that the circumferential portion of the pressing member makes a three dimensional pattern formed of recess deformed portions and non-recess deformed portions on the outer surface of the peripheral wall of the can shell, wherein during the pressing step, a recess depth of the circumferential portion of the pressing member recessed in the outer surface of the peripheral wall of the can shell is maintained at a minimum size to make the recess deformed portions be visually confirmable.

2. The method according to claim 1, wherein the pressing member includes a plurality of projections on the circumferential portion thereof with predetermined intervals along a circumferential direction, and wherein during the pressing step, the can shell is rotated and the circumferential portion of the pressing member is pressed and rotated against the outer surface of the peripheral wall of the can shell such that each projection is recessed in the outer surface of the peripheral wall of the can shell to form a plurality of recess deformed portions arrayed at predetermined intervals on the peripheral wall of the can shell, while the recess depth of each projection is maintained at a minimum size to make the recess-deformed portions be visually confirmable.

3. The method according to claim 1, wherein during the pressing step, the pressing member is moved parallel to an axis of the can shell so as to form a spiral recess deformed portion on the outer surface of the peripheral wall of the can shell.

4. The method according to any one of claims 1–3, wherein the pressing member includes a plurality of pressing members arrayed parallel to an axis direction of the can shell, and wherein during the pressing step, a circumferential portion of a corresponding pressing member is pressed against and rotated on the outer surface of the outer peripheral wall of the can shell.

5. The method according to claim 1, further comprising:

providing at least one end of the can shell with at least one from a neck in process to form a neck of the can shell, a flange process to form a flange on one end of the can shell, and a lid crimping process to form a crimped lid portion.

6. The method according to claim 1, wherein during the retaining step, the can shell is retained by gripping the can shell with a pair of retention members that contact both ends of the can shell in an axial direction thereof so as to retain the can shell with the outer surface of the peripheral wall of the can shell exposed and the interior of the can shell sealed, and wherein prior to the pressing step, the method further comprises:

introducing a gas into the interior of the can shell through a gas inlet provided to at least one of the retention members while the retaining step retains the can shell; and maintaining the interior of the can shell at a predetermined pressure by the introduced gas.

7. The method according to claim 1, wherein during the pressing step, the pressing member is press rolled along the outer surface of the peripheral wall of the can shell in a slantwise direction with respect to a circumferential direction of the can shell so as to form recess-deformed portions that are arrayed spirally throughout a predetermined range in an axial direction of the can shell.

8. The method according to claim 1, wherein during the pressing step, the recess depth of the deformed portions formed on the outer surface of the peripheral wall of the can shell by the circumferential portion of the pressing member is 0.1 to 1.2 mm from the outer surface of the peripheral wall of the can shell toward the interior of the can shell.

9. The method according to claim 1, wherein when the can shell is formed of aluminum with a thickness of 0.06 to 0.2 mm, the predetermined pressure by gas is maintained at 0.1 to 0.5 MPa, and when the can shell is formed of steel with a thickness of 0.1 to 0.3 mm, the predetermined pressure by gas is maintained at 0.1 to 0.7 MPa.

10. The method according to claim 2, wherein each projection on the pressing member has a projection height greater than a corresponding recess depth and is disposed at intervals of 1 mm or greater, and has a tip shape with a radius of curvature of 1 to 3 mm in a cross sectional shape taken along an axis of the pressing member.

11. The method according to claim 1, further comprising:

rotating the can shell; and rotating the pressing member in synchronism with the can shell and pressing the circumferential portion of the pressing member against the peripheral wall of the can shell.

12. A device for processing a can shell, comprising:

a can shell retaining device configured to retain in an exposed state an outer surface of a peripheral wall of the can shell having its interior maintained at predetermined pressure;

a pair of rotatable retention members configured to contact both ends of the can shell in an axial direction thereof to thereby grip the can shell and retain the can shell with the interior of the can shell sealed;

a rotary drive device configured to rotate the can shell around its axis through at least one of the retention members;

a pressing member disposed movably and rotatably in directions pressing against or moving away from the outer surface of the peripheral wall of the can shell being retained by the can shell retaining device; and a pressing device configured to press the pressing member against the outer surface of the peripheral wall of the can shell, wherein a circumferential portion of the pressing member is configured to make a three-dimensional-pattern formed of recess-deformed portions and non-recess-deformed portions on the outer surface of the peripheral wall of the can shell, and wherein a recess depth of recess portions of the circumferential portion are maintained at a minimum size such that the recess-deformed portions formed on the outer surface of the peripheral wall of the can shell are visually confirmable.

13. The device according to claim 12, wherein the circumferential portion of the pressing member includes a plurality of projections having predetermined shapes at predetermined intervals in the circumferential direction of the pressing member, and wherein the rotary drive rotates the can shell and the pressing device presses and rotates the circumferential portion of the pressing member against the outer surface of the peripheral wall of the can shell such that each projection is recessed in the outer surface of the peripheral wall of the can shell to form a plurality of recess deformed portions arrayed at predetermined intervals on the peripheral wall of the can shell, while the recess depth of each projection is maintained at a minimum size to make the recess-deformed portions be visually confirmable.

14. The device according to claim 12, further comprising:

a moving device configured to move the pressing member parallel to an axis of the can shell so as to form a spiral recess deformed portion on the outer surface of the peripheral wall of the can shell.

15. The device according to any one of claims 12–14, wherein the pressing member includes a plurality of pressing members arrayed parallel to an axis direction of the can shell, and the pressing device presses and rotates a circumferential portion of a corresponding pressing member against the outer surface of the outer peripheral wall of the can shell.

16. The device according to claim 12, wherein at least one end of the can shell includes at least one from a neck portion, a flange portion and a crimped portion.

17. The device according to claim 12, further comprising:

a gas inlet formed to at least one of the retention members; and a gas inlet device configured to introduce a gas into the interior of the can shell through the gas inlet and to maintain the interior of the can shell at a predetermined pressure by the gas.

18. The device according to claim 12, wherein the pressing member is disposed so as to be press rolled by the pressing device along the outer surface of the peripheral wall of the can shell in a slantwise direction with respect to a circumferential direction of the can shell so as to form recess-deformed portions at predetermined intervals in an axial direction of the can shell.

19. The device according to claim 12, wherein when the pressing device presses the pressing member against the outer surface of the peripheral wall of the can shell such that the recess depth of the deformed portions formed on the outer surface of the peripheral wall of the can shell by the circumferential portion of the pressing member is 0.1 to 1.2 mm from the outer surface of the peripheral wall of the can shell toward the interior of the can shell.

20. The device according to claim 12, wherein when the can shell is formed of aluminum with a thickness of 0.06 to 0.2 mm, the predetermined pressure by gas is maintained at 0.1 to 0.5 MPa, and when the can shell is formed of steel with a thickness of 0.1 to 0.3 mm, the predetermined pressure by gas is maintained at 0.1 to 0.7 MPa.

21. The device according to claim 13, wherein each projection on the pressing member has a projection height greater than a corresponding recess depth and is disposed at intervals of 1 mm or greater, and has a tip shape with a radius of curvature of 1 to 3 mm in a cross sectional shape taken along an axis of the pressing member.

22. The device according to claim 12, further comprising:

a pressing member rotary drive device configured to rotate the pressing member in synchronism with the can shell retained by the can shell retaining device and rotated by the rotary drive device.

* * * * *